US010123560B2

(12) United States Patent
Rasouli et al.

(10) Patent No.: US 10,123,560 B2
(45) Date of Patent: Nov. 13, 2018

(54) TOBACCO SUBSTRATE

(71) Applicant: Philip Morris Products S.A., Neuchatel (CH)

(72) Inventors: Firooz Rasouli, Midlothian, VA (US); Gianluca Sechi, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 624 days.

(21) Appl. No.: 14/398,050

(22) PCT Filed: Mar. 15, 2013

(86) PCT No.: PCT/IB2013/052094

§ 371 (c)(1),
(2) Date: Oct. 30, 2014

(87) PCT Pub. No.: WO2013/164704

PCT Pub. Date: Nov. 7, 2013

(65) Prior Publication Data

US 2015/0114405 A1 Apr. 30, 2015

Related U.S. Application Data

(60) Provisional application No. 61/640,221, filed on Apr. 30, 2012.

(30) Foreign Application Priority Data

Apr. 30, 2012 (EP) ..... 12166204

(51) Int. Cl.
*A24B 15/28* (2006.01)
*A24B 15/14* (2006.01)
(Continued)

(52) U.S. Cl.
CPC ..... *A24B 15/285* (2013.01); *A24B 15/14* (2013.01); *A24D 1/00* (2013.01); *A24D 1/002* (2013.01); *A24D 1/18* (2013.01)

(58) Field of Classification Search
None
See application file for complete search history.

(56) References Cited

U.S. PATENT DOCUMENTS 4,002,178 A 1/1977 Fiore et al.
4,274,427 A 6/1981 Lendvay
(Continued)

FOREIGN PATENT DOCUMENTS

CN 101268859 A 9/2008
EP 2241203 A2 10/2010
(Continued)

OTHER PUBLICATIONS

Lor, Lorillard,Robinson,EA. Synthesis and Testing of a Titanium Dioxide Aerogel for Removal of Mainstream Smoke Components. Jun. 5, 1998. Lorillard Records. Added to UCSF Jan. 15, 2003. (retrieved Dec. 5, 2017) <https://www.industrydocumentslibrary.ucsf.edu/tobacco/docs/szvy0069> (Year: 2003).*
(Continued)

*Primary Examiner* — Joseph S Del Sole
*Assistant Examiner* — Manley L Cummins, IV
(74) *Attorney, Agent, or Firm* — Mueting, Raasch & Gebhardt, P.A.

(57) ABSTRACT

A smoking article (10) incorporates a tobacco substrate including tobacco having a tobacco density of 150 mg/cm$^3$ or less and a hardness of 60% or greater. The tobacco substrate can include a tobacco aerogel (20).

17 Claims, 2 Drawing Sheets

(51) Int. Cl.
*A24D 1/00* (2006.01)
*A24D 1/18* (2006.01)

(56) References Cited

U.S. PATENT DOCUMENTS

| | | | | |
|---|---|---|---|---|
| 4,617,945 | A | 10/1986 | Vos et al. | |
| 4,936,920 | A * | 6/1990 | Keritsis | A24D 1/00 131/352 |
| 5,178,167 | A | 1/1993 | Riggs et al. | |
| 5,251,649 | A | 10/1993 | Cho et al. | |
| 5,533,528 | A | 7/1996 | Wallace et al. | |
| 5,649,552 | A | 7/1997 | Cho et al. | |
| 5,709,229 | A | 1/1998 | Priehs et al. | |
| 5,810,017 | A | 9/1998 | Watanabe et al. | |
| 6,575,170 | B1 * | 6/2003 | Prasad | A24B 3/182 131/309 |
| 2006/0223965 | A1 * | 10/2006 | Trifu | C08G 77/54 528/35 |
| 2007/0204870 | A1 * | 9/2007 | Deevi | B01J 23/52 131/331 |
| 2009/0260645 | A1 * | 10/2009 | Brotton | A24B 15/245 131/342 |

FOREIGN PATENT DOCUMENTS

| | | | |
|---|---|---|---|
| JP | S49-124299 | | 11/1974 |
| JP | S59-91858 | A | 5/1984 |
| JP | H05-219928 | A | 8/1993 |
| JP | H06-209752 | A | 8/1994 |
| JP | H06-335375 | A | 12/1994 |
| JP | H09-500281 | | 1/1997 |
| JP | H10-113160 | A | 5/1998 |
| JP | 3015466 | B2 | 3/2000 |
| JP | 2010-506594 | | 3/2010 |
| RU | 2045209 | C1 | 10/1995 |
| WO | WO 94/10864 | A1 | 5/1994 |
| WO | WO 2006/127772 | A2 | 11/2006 |
| WO | WO 2008/108889 | A1 | 9/2008 |
| WO | WO 2011030151 | * | 3/2011 |
| WO | WO 2013/164704 | A1 | 11/2013 |

OTHER PUBLICATIONS

International Preliminary Report on Patentability issued in PCT/IB2013/052094 by the International Bureau of WIPO dated Nov. 13, 2014; 6 pgs.

International Search Report and Written Opinion from PCT/IB2013/052094, dated Jul. 15, 2013; 9 pgs.

Office Action from the corresponding Japanese Patent Application No. 2015-509517, including English translation, dated May 9, 2018; 10 pgs.

* cited by examiner

TOBACCO SUBSTRATE

This application is the § 371 U.S. National Stage of International Application No. PCT/IB2013/052094, filed 15 Mar. 2013, which claims the benefit of U.S. Provisional Application No. 61/640,221, filed 30 Apr. 2012 and European Application No. 12166204.3, filed 30 Apr. 2012, which are incorporated by reference herein in their entireties.

The present disclosure relates to a smoking article with a tobacco substrate having firmness and air flow properties that can be substantially independent of the amount of tobacco in the tobacco substrate.

Smoking articles typically include a tobacco substrate. For example, conventional cigarettes have a tobacco rod as a tobacco substrate, along with a filter connected in end-to-end relationship with the tobacco rod. In other examples, the smoking article includes a tobacco substrate that is configured to be heated rather than combusted. In yet other examples, the smoking article includes a tobacco substrate that is configured to be neither heated nor combusted. In some such examples, the smoking article may be configured to deliver one or more components of the tobacco using the passage of air through the smoking article, using a chemical reaction, or a combination of the passage of air and a chemical reaction.

For conventional combustible smoking articles, some consumers prefer cigarettes that have a reduced particulate matter delivery (sometimes referred to as a low tar delivery). For example, some such cigarettes have less than 3 mg tar delivery, less than 1 mg tar delivery, or less than 0.1 mg tar delivery. The use of expanded tobacco is known for this purpose. However, when the tobacco density is below a certain level, the firmness and integrity of the tobacco substrate can become unacceptable. In addition, some expected flavour components in tobacco are vaporized when forming expanded tobacco.

For certain smoking articles, it is desirable for air to be able to flow through the tobacco substrate. It may also be desirable for air flowing through the tobacco substrate to have a relatively high level of contact with the tobacco in the tobacco substrate.

In addition, in certain cases it has been proposed to add certain functional materials to tobacco substrates. For example, it has been proposed to add catalysts, sorbents, flavorants, or combinations thereof, to a tobacco substrate in order to affect one or more properties of the gas and particulate matter traveling through the tobacco substrate.

Aerogels are synthetic highly porous material derived from a gel, where the liquid component in the gel has been replaced with a gas. The result is a solid with an open cell structure and low density. Despite their name, aerogels are rigid, dry materials that do not resemble a gel in their physical properties; the name comes from the fact that they are derived from gels. By weight, gels are mostly liquid but behave like solids due to a three-dimensional cross-linked network within the liquid. Gels generally are a dispersion of molecules of a liquid within a solid in which the solid is the continuous phase and the liquid is the dispersed phase.

Aerogels are often friable but are typically structurally strong. In some cases, their impressive load bearing ability can be traced to a dendritic microstructure, in which spherical particles of average size of about 2-5 nanometers are fused together in clusters. These clusters can form a three dimensional highly porous structure of almost fractal chains, in some cases with pores just under about 100 nanometers. The average size and density of the pores can be controlled during the manufacturing process.

For simplicity, this application refers to aerogels, but one of ordinary skill in the art would also understand that the tobacco substrate could include any open pore structure that is converted from a gel, for example xerogels and cryogels as well as, or in place of, aerogels. As such, in many embodiments, an open pore structure that is converted from a gel may be substituted for the aerogels used below, or the aerogel may be substituted by a xerogel or cryogel.

It would be desirable to provide novel smoking articles that have a tobacco substrate having a reduced amount of tobacco compared to conventional smoking articles while maintaining the hardness or firmness of the tobacco substrate. It would also be desirable to be able to tailor the air flow properties (for example, the resistance to draw, that is, RTD) through the tobacco substrate.

It would also be desirable to provide novel smoking articles that have a tobacco substrate with a large surface area that can be utilized to improve the efficiency of functional materials. Improving the efficiency of functional materials in the tobacco substrate may allow for the incorporation of a lower amount of functional material in the tobacco substrate, while maintaining the desired results obtained by the functional material.

According to the current disclosure, there is provided a smoking article with a tobacco substrate having a tobacco density of 150 mg/cm$^3$ or less and a firmness of 4 mm or less (equating to a hardness of about 60% or greater). This smoking article has air flow properties (such as resistance to draw) and firmness or hardness that is substantially independent of the amount of tobacco in the tobacco substrate. In addition, the smoking article can provide a tar delivery level that is substantially independent of the firmness of the tobacco substrate.

In many embodiments the smoking article has at least a portion of a tobacco substrate is converted from a gel to an open pore structure and includes tobacco. In many embodiments the smoking article has a tobacco substrate that includes an aerogel and tobacco. Functional materials can be dispersed in the aerogel and the specific functional material and the amount of functional material can be selected based on the desired result to be obtained with the functional material. Tobacco can be dispersed in the aerogel and an amount of tobacco can be selected based on the desired result (such as tar delivery) of the tobacco substrate. The aerogel can be utilized to provide structural properties of the tobacco substrate. For example, the aerogel can be formed as a monolithic or continuous element forming all or a portion of the tobacco substrate. In other examples, the aerogel can be incorporated into the tobacco substrate as a plurality of particles dispersed in the tobacco substrate.

Smoking articles according to the present disclosure provide an effective way to improve the tobacco substrate by incorporating tobacco in aerogel. The aerogel allows the tobacco content to be specifically tailored within the tobacco substrate as desired. The aerogel also allows the tobacco substrate to have a high surface area for contact with the particulate and gas streams flowing through the substrate, increasing the efficiency of functional materials that are dispersed within the aerogel. The aerogel can be formed in any shape and can provide physical or structural properties to the tobacco substrate that can be substantially independent of the amount of tobacco in the tobacco substrate.

In some embodiments, smoking articles according to the present disclosure include a tobacco substrate with an aerogel forming an open pore structure. The tobacco substrate includes tobacco dispersed within the aerogel. The aerogel can form some or all of the physical structure of the tobacco substrate or can be in the form of a plurality of aerogel particles dispersed in a tobacco substrate. In many embodiments, the aerogel forms the physical structure of the tobacco rod. For example, the aerogel may provide the structural properties that provide the desired shape or firmness, or both the shape and firmness, found in tobacco rods.

The term "open pore structure" refers to a structure that includes a network or matrix defining interconnected voids or pores. An aerosol, gas, or vapour can pass through the open pore structure via the interconnected voids or pores of the aerogel. In many embodiments, the voids or pores have an average size of less than 500 micrometers, or less than 250 micrometers, or less than 100 micrometers. The size of the voids or pores can be determined by cutting through a particle or a portion of a monolithic element of the open pore structure and measuring the largest cross-sectional dimension of each of the voids or pores. The average size of the voids or pores is the arithmetic mean of these measurements. This open pore structure allows gases and in some cases particulate matter entrained with the gases, to flow through the aerogel structure. The pore size of the open pore structure can be chosen to provide a resistance to draw that is similar to a resistance to draw of a tobacco rod of a conventional smoking article. In many embodiments the tobacco rod including an aerogel or open pore structure has a resistance to draw in a range from about 10 to about 70 mm $H_2O$ or from about 20 to about 50 mm $H_2O$. In many embodiments the smoking article (including both the tobacco rod including an aerogel or open pore structure and the other elements of the smoking article) has a resistance to draw in a range from about 50 to about 140 mm $H_2O$ or from about 60 to about 120 mm $H_2O$. Thus the smoking experience for some smoking articles described herein may be comparable to conventional smoking articles.

The term "firmness" refers to resistance to compression. Firmness is typically determined by placing 15 cigarettes in three levels of six, five, and four in a holder having a fixed area trapezoidal shaped shoe. The holder is shaped such that six cigarettes occupy the base level, five cigarettes occupy the middle level, and four cigarettes occupy the upper level, with the sides of the holder fitting snugly around these. An open top in the holder exposes the four cigarettes of the upper level to a compression plate. The filled cigarette holder is placed under the compression plate in such a way that the compression plate is properly placed to make contact with the center 40 mm section of the four cigarette tobacco substrates directly in contact with the plate (the plate is sufficiently wide to contact all four top cigarettes and it is 40 mm long in order to contact the center 40 mm section, as mentioned). The cigarettes are initially compressed with a 100 g plate weight until they stabilize in place. Then, an additional weight of 1400 g is applied to the sample for 30 seconds. At the end of 30 seconds, the compression value is measured in mm, which is indicative of cigarette firmness. This testing is accomplished at an ambient temperature of 22±2 degrees centigrade. In many embodiments the smoking article has a firmness of about 4 mm or less, or 3.5 mm or less, or 3 mm or less, or 2.5 mm or less. In some preferred embodiments, the smoking article has a firmness of between about 3.5 mm and about 2.5 mm.

The term "hardness" also refers to resistance to compression. Hardness is typically determined by applying a load of 2 kg across ten cigarettes for 20 seconds and measuring the average (mean) depressed diameters of the cigarettes. Hardness=(depressed diameter/nominal non-depressed diameter)×100%. This testing is accomplished at an ambient temperature of 22±2 degrees centigrade. Testing can be accomplished using a device made commercially available under the trade designation Densimeter DD60A (Borgwaldt KC GmbH, Hamburg, Germany). Such a device has two pairs of parallel metal cylinders, with each cylinder being 160 mm in length and 10 mm in diameter. Two cylinders are placed in parallel arrangement 16 mm apart below the cigarettes and act as a support for the cigarettes, with the cigarettes placed so that the tobacco rod bridges across the two cylinders (any filter present would not be in contact with the cylinders during the test). The second pair of cylinders are aligned with the first pair of cylinders such that, during the test, the first pair of cylinders and the second pair of cylinders approach one another, with the cigarettes in between. The pair of cylinders that support the cigarettes remains stationary during testing. The other pair of cylinders is arranged to move towards the ten cigarettes and translate the load of 2 kg across the tobacco rods of the ten cigarettes. The load is held on the cigarettes for 20 seconds and the compressed dimension measured, then the test is completed. The cigarettes are also placed apart from one another so that they do not contact one another during the test. A frame can be used to support the tips of the ten cigarettes and help ensure that the ten cigarettes remain parallel with, and equally spaced from, each other during testing.

The hardness may also depend on the oven volatiles (OV) of the tobacco rod, and as such a determination of, and a correction for, the OV should be made. This corrected hardness is calculated with the following formula: Corrected Hardness=Measured Hardness+(Standard Oven Volatiles−Measured Oven Volatiles)*Correction Factor. The Standard Oven Volatiles is usually taken to be 12.5%, but another standard value could be used if desired. The correction factor is −3.3.

It is understood that firmness values correspond to hardness values. For firmness, the higher the value, the softer the cigarette. For hardness, the higher the value, the harder the cigarette. For a standard diameter cigarette (i.e., 7.85 mm diameter) the equation to find hardness is approximately, Hardness=100−10×(firmness). For example, in some embodiments, the tobacco substrate has a firmness of about 4.0 mm or less (hardness of about 60% or more), about 3.5 mm or less (hardness of about 65% or more), or about 3.0 mm or less (hardness of about 70% or more), or 2.5 mm or less (hardness of about 75% or more). In some embodiments, the tobacco substrate has a firmness of between about 3.5 mm (hardness of about 65%) and about 2.5 mm (hardness of about 75%).

The following test can be used for measuring oven volatiles. A sample of tobacco material is placed in a sealed container under normal atmospheric conditions (60 percent relative humidity at 22 degrees Celsius), and the weight of this sample with the container is taken. The container is then placed in an oven at 103 degrees Celsius, and a lid of the container is moved to expose the sample to the oven. The sample and open container are left in the oven at 103 degrees Celsius for 100 minutes. The sample and container are then removed from the oven, and the lid replaced, and the sealed container and sample are left to cool outside the oven for a minimum of 20 minutes. The combined weight of the container with sample is then re-taken and the measured oven volatiles calculated with the following formula: Measured Oven Volatiles=(First measured weight−second measured weight/first measured weight−weight of container)*100.

The term "tobacco density" refers to the mass of tobacco (measured in grams) per unit volume of tobacco substrate or rod (expressed as $cm^3$).

Aerogels that are useful for tobacco substrate can have a density of less than about 0.35 g/cm$^3$ or less than about 0.1 g/cm$^3$ or less than about 0.05 g/cm$^3$. These aerogels can have a surface area greater than about 500 m$^2$/g or greater than about 750 m$^2$/g or greater than about 1000 m$^2$/g, as determined by mercury intrusion porosimetry. These aerogels can have at least about 50% void space (or gas volume) or at least about 75% void space or at least about 90% void space.

Aerogels that are useful for tobacco substrate can be formed by creating a gel in solution and then carefully removing the liquid to leave the aerogel structure intact. The gel is formed by combining tobacco with a gelling agent and a liquid, for example. In many embodiments, the liquid is removed from the gel via supercritical extraction or supercritical drying.

Supercritical extraction or drying is performed by increasing the temperature and pressure of the gel to force the liquid into a supercritical fluid (where its liquid and gaseous phases become indistinguishable). By subsequently dropping the pressure the liquid is vaporized and removed, forming an aerogel.

In some embodiments, the gel is placed in a pressure vessel and the pressure vessel is filled with liquid carbon dioxide. The liquid carbon dioxide is essentially a solvent that can displace the liquid (such as water or solvent) in the pores in the gel. The gel is soaked in liquid carbon dioxide over the course of several days. The carbon dioxide replaces the liquid in the pores of the gel. Then the carbon dioxide is heated past its critical temperature (31 degrees centigrade) and pressure (73 atm). The vessel is then isothermally depressurized, resulting in the aerogel.

In many embodiments, a gel is produced by combining tobacco, a gelling agent and water. The tobacco can form a portion of the aerogel open pore structure and can define at least a portion of the open pores or voids forming the open pore structure. The tobacco can be utilized in any useful form and is present in the gel and aerogel as a plurality of tobacco particles or elements.

In embodiments where the tobacco substrate comprises aerogel, preferably the aerogel is an organic aerogel. The term "organic aerogel" refers to an aerogel preferably comprising at least about 75% by weight, more preferably at least 90% by weight, even more preferably consisting essentially of, or most preferably consisting of, organic compounds. Organic compounds include any compounds commonly referred to as organic, for example those falling under the IUPAC nomenclature of organic chemistry (commonly referred to as the "Blue Book"). Examples include natural or synthetic polymers, sugars, proteins, cellulosic material and the like.

This is in contrast to other materials, such as activated carbon materials, which are generally not considered organic compounds. For example, some materials (including some organic compounds) can be carbonized, pyrolyzed, or otherwise heated in order to create activated carbon structures, but after the material has been activated it would no longer be considered an organic compound. In some cases, the organic aerogel is not carbonized, pyrolyzed, or otherwise heated above 150 degrees C.

In addition, the materials of the aerogel are preferably non-crosslinked in order to maintain an open pore structure.

In many embodiments, tobacco has an average particle size greater than about 25 micrometers, or greater than about 50 micrometers, or greater than about 100 micrometers. In the alternative, or in addition, the tobacco has an average particle size less than about 1000 micrometers, or less than about 750 micrometers, or less than about 500 micrometers. In many embodiments the tobacco is present in the gel or aerogel in a shredded form, having an average aspect ratio of at least about 3 or at least about 5. For the purposes of the present invention, the "particle size" is considered to be the largest cross sectional dimension of the individual particles within the particulate material. The "average" particle size refers to the arithmetic mean particle size for the particles. The particle size distribution for a sample of particulate material may be determined using a known sieve test.

In some embodiments, fine tobacco particles have an average particle size in a range of less than 50 micrometers, or less than 25 micrometers, or less than 10 micrometers, or in a range from about 3 to 50 micrometers or from about 3 to 25 micrometers. In certain embodiments, the tobacco is a mixture of fine tobacco particles the larger tobacco particles described above.

Tobacco can be specifically included in the gel and the resulting aerogel to obtain a desired tobacco loading in the tobacco substrate. Tobacco can be combined with aerogel precursor materials (such as gelling agent and liquid) and utilized to form the tobacco dispersed in the aerogel. The tobacco content can be tailored to achieve a specified tar level in a conventional smoking article.

The amount of tobacco in aerogel can be at least about 5% or at least 10% or at least about 25%, on a weight basis. In the alternative, or in addition, the amount of tobacco in the aerogel can be less than 40%, or less than 30% on a weight basis. As compared to a conventional filter cigarettes, the smoking articles of the present disclosure can contain at least about 10% less tobacco, or at least about 20% less tobacco, or at least about 30% less tobacco, on a per unit weight basis while maintaining the firmness of the tobacco rod. In many embodiments, tobacco substrates of the present disclosure can contain less than about 300 mg of tobacco, or less than 225 mg of tobacco, or less than 150 mg of tobacco, while maintaining a tobacco rod firmness value at least equal to or greater than a firmness value of a conventional tobacco rod. Thus, the firmness of the tobacco rod is generally independent of the amount of tobacco in the tobacco rod.

Conventional tobacco rods can have a tobacco density of about 240 mg/cm$^3$ with a firmness of about 3.0 mm. In many embodiments the tobacco substrate described herein have a tobacco density of less than about 200 mg/cm$^3$ or less than 150 mg/cm$^3$ or less than about 100 mg/cm$^3$ or less than about 80 mg/cm$^3$. The tobacco substrate may also have a tobacco density of greater than about 25 mg/cm$^3$ or greater than about 40 mg/cm$^3$ or greater than about 60 mg/cm$^3$. The tobacco substrate may also have a tobacco density in the range from about 25 to about 200 mg/cm$^3$ or in a range from about 25 to about 150 mg/cm$^3$. In some embodiments, the tobacco substrate has a firmness of about 4.0 mm or less (hardness of 60% or more), about 3.5 mm or less (hardness of 65% or more), or about 3.0 mm or less (hardness of 70% or more), or 2.5 mm or less (hardness of 75% or more). In some embodiments, the tobacco substrate has a firmness of between about 3.5 mm (hardness of about 65%) and about 2.5 mm (hardness of about 75%).

Conventional smoking articles of the present disclosure can provide a specific tar level while maintaining the firmness of the tobacco substrate. Specific amounts of tobacco can be combined with the gelling agent and water to achieve a particular tar level in the resulting smoking article with the tobacco aerogel. Tar level can be chosen between about 0.1 mg to about 10 mg, or between about 0.1 to about 6 mg, or between about 0.1 and about 3 mg. The tar level can be determined when the smoking article is smoked under ISO conditions (35 puffs lasting 2 seconds each, every 60 seconds). The term "tar level" is used to refer to the total nicotine free dry particulate matter (NFDPM) of a smoking article under ISO conditions.

The term "gelling agent" refers to a material that, when mixed with tobacco and liquid at appropriate proportions and processing conditions, converts the tobacco and liquid from a flowable liquid to a moldable solid, semi-solid or gel. Gels include a solid three-dimensional network that spans the volume of liquid medium and entangles it through surface tension effects.

In many embodiments the gelling agent is a polysaccharide or protein, or combinations of one or more polysaccharides and one or more proteins. Polysaccharides can include starches, vegetable gums, agar, carrageenan or pectins, or combinations thereof, for example. Gelling agents can also include alginates or alginate salts such as, alginic acid, sodium alginate, potassium alginate, ammonium alginate or calcium alginate, or combinations thereof, for example. Protein gelling agents can include gelatin, for example. These gelling agents are acceptable for use in combination with the combustion of the tobacco. Other gelling agents may also be suitable, for example where the smoking article is a non-combustible smoking article. As examples, additional gelling agents include synthetic or natural polymer such as cellulose acetate, polystyrene, polylactic acid, and the like. In some embodiments the gelling agent is paper or cellulosic material. Preferred gelling agents include pectin, sodium alginate, calcium alginate, gum arabic and collagens, such as gelatin.

A liquid can be combined with the tobacco and gelling agent to form the gel and resulting aerogel. Liquids can include solvents, or water, or solvents and water. Useful solvents include ethanol, methanol, acetone, methyl ethyl ketone, 2-propanol, carbon dioxide, hexane, and toluene, for example.

The tobacco aerogel can be formed in any useful or desired shape. The tobacco gel can be molded into any useful form and then the liquid is removed resulting in a similarly shaped aerogel element. In many embodiments, the aerogel element is a continuous element forming at least a portion of the tobacco substrate or tobacco rod of a smoking article. In this manner, the tobacco aerogel provides structural properties to the tobacco substrate and allows the tobacco substrate to possess a desired firmness with a reduced amount of tobacco, as compared to conventional tobacco rods. In many embodiments the tobacco aerogel element is a monolithic or continuous structural element forming a tobacco rod of a cigarette.

A plurality of open channels can extend thought a length of the continuous aerogel element. These open channels can be formed via any useful method. In many embodiments, these open channels are formed during a molding process. Tobacco gel can be disposed in the cavity of the molding element defined by side surfaces and a bottom surface. In some embodiments, a plurality of elongated channel forming members are fixed to the bottom surface and extend through a length of the tobacco aerogel. In other embodiments, the plurality of elongated channel forming members are fixed to a support element that is movable relative to the molding element. The elongated channel forming members define a void space or channel through the tobacco aerogel once the tobacco aerogel is formed and removed from the cavity of the molding element.

The elongated channel forming members can have any useful diameter such as, about 25 micrometers or less, or about 15 micrometers or less. Any useful number of channel forming members can be disposed in the cavity of the molding element such as at least about 10 or at least about 20. The channel forming members can extend along the entire length of the tobacco aerogel or at least about 90% or at least about 75% of the length of the tobacco aerogel. In some embodiments, the tobacco aerogel is formed as a plurality of particles having any useful size. In these embodiments the tobacco aerogel particles have an average size of at least about 50 micrometers, or at least about 100 micrometers, or at least about 250 micrometers. Alternatively, or in addition, the tobacco aerogel particles have an average size of less than about 5000 micrometers, or less than about 1000 micrometers, or less than about 500 micrometers.

The aerogel can optionally include a functional material. The functional material can be combined with the gelling agent, tobacco and water or solvent to form the gel and the resulting aerogel. The functional material can be dispersed within the open pore structure of the aerogel. The aerogel provides a high surface area that may improve the efficiency of the functional material. Thus, a lower amount of functional material can be utilized with the open pore structure of the aerogel, as compared to conventional smoking articles. The functional material can be incorporated into the aerogel structure, essentially "locking" the functional material into the aerogel matrix or structure. The functional material can include a flavourant material or a material that captures or converts smoke constituents.

Flavourant material includes liquid flavourant or particles of a sorbent or cellulosic material impregnated with liquid flavourant or herbaceous material. Flavourants include, but are not limited to, natural or synthetic menthol, peppermint, spearmint, coffee, tea, spices (such as cinnamon, clove and ginger), cocoa, vanilla, fruit flavours, chocolate, eucalyptus, geranium, eugenol, agave, juniper, anethole and linalool. In addition, flavourant includes an essential oil, or a mixture of one or more essential oils. An "essential oil" is an oil having the characteristic odour and flavour of the plant from which it is obtained. Suitable essential oils include, but are not limited to, peppermint oil and spearmint oil. In many embodiments the flavourant comprises menthol, Eugenol, or a combination of menthol and Eugenol.

The term "herbaceous material" is used to denote material from an herbaceous plant. A "herbaceous plant" is an aromatic plant, the leaves or other parts of which are used for medicinal, culinary or aromatic purposes and are capable of releasing flavour into smoke produced by a smoking article. Herbaceous material includes herb leaf or other herbaceous material from herbaceous plants including, but not limited to, mints, such as peppermint and spearmint, lemon balm, basil, cinnamon, lemon basil, chive, coriander, lavender, sage, tea, thyme and carvi. The term "mints" is used to refer to plants of the genus *Mentha*. Suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens variegata.*

Material that captures or converts smoke constituents includes sorbents such as activated carbon, coated carbon, active aluminium, zeolites, sepiolites, molecular sieves, and silica gel. Material that captures or converts smoke constituents includes catalysts such as manganese, chromium, iron, cobalt, nickel, copper, zirconium, tin, zinc, tungsten, titanium, molybdenum, vanadium materials.

The term "smoke" or "tobacco smoke" refers to the aerosol or vapor given off as a tobacco material undergoes combustion, pyrolysis, heating or chemical reaction.

In many embodiments the overall length of smoking article is between about 70 mm and about 128 mm, or about 84 mm. The external diameter of smoking article can be between about 5 mm and about 8.5 mm, or between about 5 mm and about 7.1 mm for slim sized smoking articles or between about 7.1 mm and about 8.5 mm for regular sized smoking articles.

The resistance to draw (RTD) of the smoking articles of the present disclosure can vary based on the incorporation and structure of the tobacco aerogel in the tobacco substrate. The RTD refers to the static pressure difference between the two ends of the specimen when it is traversed by an air flow under steady conditions in which the volumetric flow is 17.5 milliliters per second at the output end. The RTD of a specimen can be measured using the method set out in ISO Standard 6565:2002.

Any of the above tobacco substrates may be used in a conventional combustible smoking article such as a cigarette, or may be used in a non-combustible smoking article, for example a smoking article that is configured to deliver a component of tobacco using heat, air flow or a chemical reaction.

Smoking articles according to the present invention may be packaged in containers, for example in soft packs or hinge-lid packs, with an inner liner coated with one or more flavourants.

The disclosure will be further described, by way of example only, with reference to the accompanying drawings, in which.

Figure 1:
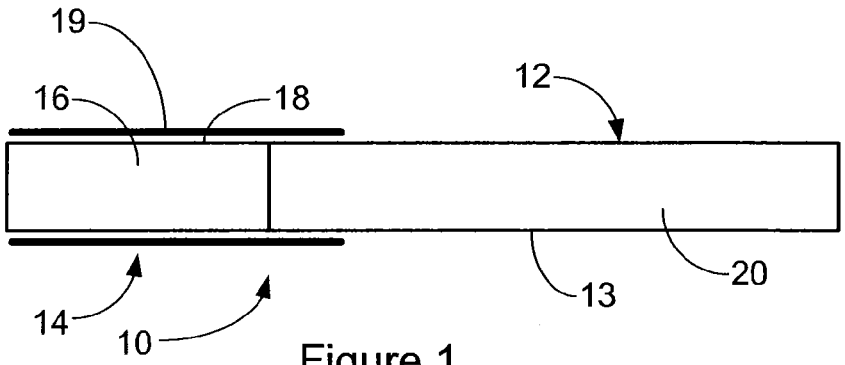
FIG. 1 shows a schematic cross section view of a smoking article according to the present disclosure having a tobacco substrate formed of a tobacco aerogel.
Figure 2:
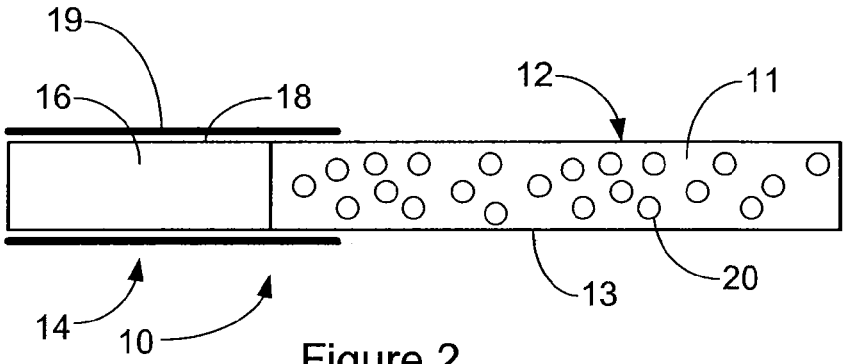
FIG. 2 shows a schematic cross section view of a smoking article according to the present disclosure having a tobacco substrate formed of a plurality of tobacco aerogel particles dispersed in a tobacco rod.

The smoking article 10 shown in FIG. 1 and FIG. 2 includes a tobacco substrate or tobacco rod 12 attached to an axially aligned filter 14. The filter 14 includes a filter plug 16 that can be formed of cellulose acetate wrapped in plug wrap 18. Tipping paper 19 joins the tobacco rod 12 to the axially aligned filter 14.

Cigarette wrapper 13 surrounds the tobacco substrate which can include the tobacco aerogel 20 in FIG. 1 and tobacco cut filler 11 and tobacco aerogel particles 20 in FIG. 2. FIG. 1 illustrates a monolithic tobacco aerogel element 20 forming the structure of the tobacco substrate 12. The illustrated monolithic tobacco aerogel element 20 in FIG. 1 is a cylindrical element forming the tobacco substrate 12 of the smoking article 10.

FIG. 2 illustrates the tobacco substrate 12 formed of a plurality of tobacco aerogel particles 20 dispersed in tobacco material or cut tobacco filler 11.

Figure 3:
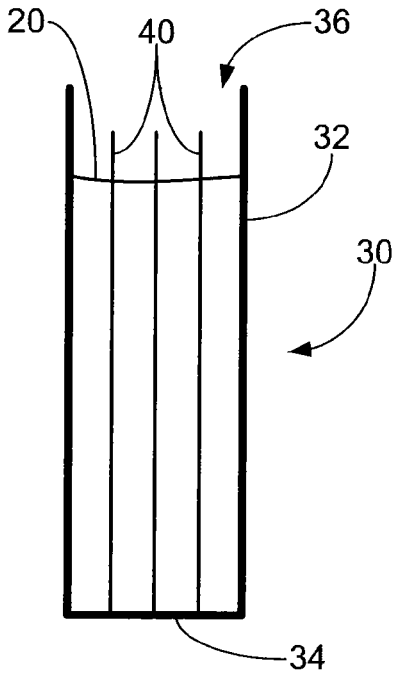
FIG. 3 shows a schematic diagram side view of an molding element.

FIG. 3 shows a schematic diagram side view of an molding element 30 that can be utilized in the formation of the tobacco aerogel 20. The tobacco gel can be disposed in the cavity 36 of the molding element 30. The cavity 36 is defined by side surfaces 32 and a bottom surface 34. A plurality of elongated channel forming members 40 are fixed to the bottom surface 34 and extend through a length of the tobacco aerogel 20. The elongated channel forming members 40 define a void space or channel through the tobacco aerogel 20 once the tobacco aerogel 20 is formed and removed from the cavity 36 of the molding element 30.

The elongated channel forming members 40 can have any useful diameter such as, about 25 micrometers or less, or about 15 micrometers or less. Any useful number of channel forming members 40 can be disposed in the cavity 36 of the molding element 30 such as at least about 10 or at least about 20. The channel forming members 40 can extend along the entire length of the tobacco aerogel 20 or at least about 90% or at least about 75% of the length of the tobacco aerogel 20.

Figure 4:
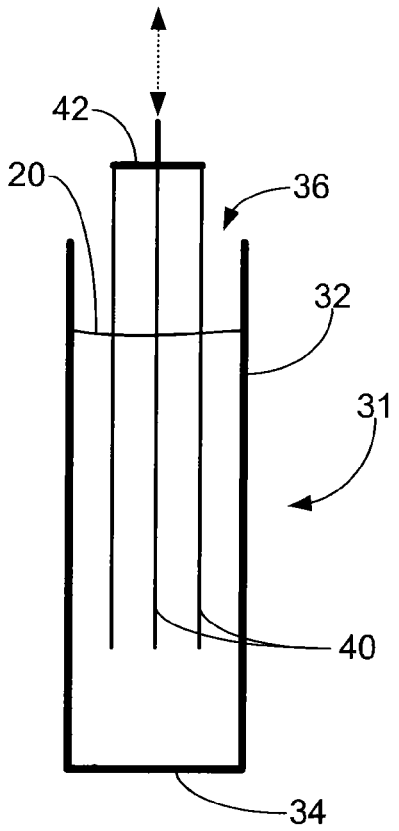
FIG. 4 shows a schematic diagram side view of another molding element.

FIG. 4 shows a schematic diagram side view of another molding element 31. In this embodiment the elongated channel forming members 40 are movable relative to the cavity 36 of the molding element 30. The elongated channel forming members 40 are fixed to a support element 42 that is longitudinally movable relative to the cavity 36 of the molding element 30 along the length of the side surfaces 32 and moving toward and away from the bottom surface 34. The elongated channel forming members 40 extend through a length of the tobacco aerogel 20 and are described above. The elongated channel forming members 40 define a void space or channel through the tobacco aerogel 20 once the tobacco aerogel 20 is formed and removed from both the cavity 36 of the molding element 30 and the elongated channel forming members 40.

The invention claimed is:

1. A smoking article comprising a tobacco substrate, the tobacco substrate comprising an organic aerogel defining a continuous element having an open poor structure with void space of 75% or greater; and tobacco dispersed in the organic aerogel.

2. A smoking article according to claim 1 wherein the tobacco substrate having a tobacco density of about 150 $mg/cm^3$ or less and a hardness of 60% or greater.

3. A smoking article according to claim 2 wherein the aerogel comprises at least about 5 wt % tobacco.

4. A smoking article according to claim 2 wherein the open pore structure comprises a polysaccharide or protein.

5. A smoking article according to claim 2 wherein the open pore structure has a density of less than about 0.35 $g/cm^3$.

6. A smoking article according to claim 2 wherein the open pore structure is a plurality of particles.

7. A smoking article according to claim 2 wherein the open pore structure comprises a functional material that captures or converts smoke constituents.

8. A tobacco substrate comprising:

an organic aerogel defining a continuous element having an open pore structure with void space of 75% or greater; and tobacco dispersed in the organic aerogel.

9. A tobacco substrate according to claim 8 wherein the aerogel has a density of less than about 0.35 $g/cm^3$.

10. A tobacco substrate according to claim 8 wherein the aerogel comprises at least about 5 wt % tobacco.

11. A tobacco substrate according to claim 8 wherein the continuous element forms the tobacco substrate.

12. A tobacco substrate according to claim 8 wherein the aerogel comprises a functional material that captures or converts smoke constituents.

13. A tobacco substrate according to claim 8 wherein the aerogel is plurality of particles.

14. A tobacco substrate according to claim 8 wherein the aerogel comprises a polysaccharide or protein.

15. The tobacco substrate of claim 8, wherein the tobacco substrate includes 40% or less tobacco.

16. The tobacco substrate of claim 8, wherein the tobacco substrate is a cigarette rod element.

17. The tobacco substrate of claim 8, wherein the aerogel comprises a functional material comprising a flavorant.

* * * * *